US005855455A

United States Patent [19]

Williford et al.

[11] Patent Number: 5,855,455

[45] Date of Patent: Jan. 5, 1999

[54] SUBMERSIBLE AND SEMI-SUBMERSIBLE DRY LIFT CARRIER AND METHOD OF OPERATION FOR CARRYING A DRILLING RIG AND PLATFORM

[75] Inventors: Frank B. Williford, Frisco; Thomas C. Baucke, Dallas, both of Tex.

[73] Assignee: Ensco International, Inc., Dallas, Tex.

[21] Appl. No.: 890,291

[22] Filed: Jul. 9, 1997

[51] Int. Cl.[6] ..... E02B 17/00; E02D 25/00

[52] U.S. Cl. ..... 405/196; 405/209; 114/265

[58] Field of Search ..... 405/196, 197, 405/198, 199, 200, 203, 204, 205, 206, 207, 208, 209; 114/264, 265

[56] References Cited

U.S. PATENT DOCUMENTS

| | | | |
|---|---|---|---|
| 2,308,743 | 1/1943 | Bulkley et al. | 405/196 |
| 2,900,794 | 8/1959 | Sutton | 405/204 |
| 2,953,904 | 9/1960 | Christenson | 405/196 |
| 3,001,370 | 9/1961 | Templeton | 405/200 |
| 3,277,653 | 10/1966 | Foster | 405/203 X |
| 3,385,069 | 5/1968 | Estes | 405/196 |
| 3,433,024 | 3/1969 | Diamond et al. | 405/196 |
| 3,605,415 | 9/1971 | Mohlman | 114/264 X |
| 3,699,688 | 10/1972 | Estes | 405/197 |
| 3,727,414 | 4/1973 | Davies | 405/196 |
| 3,826,099 | 7/1974 | Lovie | 114/265 X |
| 3,871,184 | 3/1975 | Schirtzinger | 405/201 |
| 3,872,679 | 3/1975 | Fischer | 405/200 |
| 3,911,844 | 10/1975 | Foreman | 114/264 |
| 3,918,380 | 11/1975 | Graham et al. | 114/264 |
| 3,967,457 | 7/1976 | Lovie | 405/198 |
| 4,040,265 | 8/1977 | Hellerman et al. | 405/196 |
| 4,056,943 | 11/1977 | Terrant | 405/196 |
| 4,161,376 | 7/1979 | Armstrong | 405/196 |
| 4,380,406 | 4/1983 | Ayers | 405/206 |
| 4,511,288 | 4/1985 | Wetmore | 405/217 |
| 4,602,894 | 7/1986 | Lorenz et al. | 405/203 |
| 4,627,767 | 12/1986 | Field et al. | 405/196 |
| 4,666,341 | 5/1987 | Field et al. | 405/217 |
| 4,723,875 | 2/1988 | Sutton | 405/204 |
| 4,729,695 | 3/1988 | Silvestri | 405/204 |
| 4,761,097 | 8/1988 | Turner | 405/204 |
| 4,907,912 | 3/1990 | Smith | 405/208 |
| 5,011,335 | 4/1991 | Field | 405/204 |
| 5,593,250 | 1/1997 | Smith et al. | 405/205 |

OTHER PUBLICATIONS

Bendix Skagit Corporation Brochure dated Sep., 1980 for AED–300 Mooring Winch.

A Primer of Offshore Operations, Second Edition, publication/training manual, by Ron Baker, published by Petroleum Extension Service, University of Texas, 1985.

*Primary Examiner*—Tamara L. Graysay
*Assistant Examiner*—Jong-Suk Lee
*Attorney, Agent, or Firm*—Russell N. Rippamonti

[57] ABSTRACT

A submersible/semi-submersible dry lift carrier for transporting a jack-up drilling rig in a body of water includes a hull, a deck, at least one stability column, and a plurality of ballast compartments capable of being flooded and emptied for lowering and raising the carrier. The carrier further includes at least three leg wells, each well sized and spaced for receiving a leg from a jack-up drilling rig, and each of said wells comprising a vertical passageway having a first end opening through the deck and a second end opening through the bottom of the hull. The carrier further includes at least three pinning receptacles, each receptacle sized and spaced for receiving a spud can and leg from a jack-up drilling rig. In operation, the dry lift carrier is partially submerged by flooding the ballast compartments and then positioned beneath the floating jack-up rig. The carrier is de-ballasted thereby lifting the jack-up rig from a floating "wet" mode to a "dry" mode on the deck of the carrier. Alternatively, the dry lift carrier is submerged and rests on the floor of the body of water. The floating jack-up rig is positioned over the dry lift carrier. The carrier is de-ballasted thereby lifting the jack-up rig on the deck of the carrier.

34 Claims, 7 Drawing Sheets

SUBMERSIBLE AND SEMI-SUBMERSIBLE DRY LIFT CARRIER AND METHOD OF OPERATION FOR CARRYING A DRILLING RIG AND PLATFORM

TECHNICAL FIELD

This invention relates to marine vessels and, more particularly, to a submersible/semi-submersible dry lift carrier used for dry transportation of jack-up rigs.

BACKGROUND OF THE INVENTION

The present invention is a marine vessel for transporting mobile offshore drilling units (MODU's) from one drill site in the water to another. There are two basic types of MODUs used to drill most offshore wells: (1) bottom supported units including submersibles and jack-ups; and (2) floating units including inland barge rigs, drill ships, ship-shaped barges and semi-submersibles.

When a bottom supported MODU is on site and drilling a well, a part of its structure is in contact with the sea floor. The remainder of the rig is supported above the water. A jack-up, or self-elevating, rig is a popular design of the MODUs. Jack-ups are popular because they can drill in relatively deep water (generally up to 350 feet), provide a very stable drilling platform since part of their structure is in firm contact with the sea floor and are movable from one location to another.

Generally, two basic types of jack-ups are available. The first, a mat supported jack-up, has steel legs which are permanently attached to the "mat" at their distal ends. The mat comprises a steel frame having a plurality of ballast compartments that may be used to make the mat buoyant, neutrally buoyant, or negatively buoyant. When a mat supported jack-up is conducting drilling operations, the mat is negatively buoyant and is positioned in contact with the sea floor. In general, mat supported jack-ups are used where the sea bottom is soft and muddy. The mat distributes the weight of the rig evenly over the bottom and tends to keep it from sinking too far into a soft bottom. The mat functions similar to a stepping stone in a muddy patch of ground.

The second type of jack-up rig is the independent leg jack-up which typically has large open truss legs. The truss legs are terminated at the distal end with spud cans. Spud cans are steel cylinders with or without pointed ends. A spud can functions similar to a foundation pile that is jammed into the ground. If the sea floor is not too soft and muddy, the spud can penetrates the sea floor a short distance and supports the rig both vertically and laterally. This is referred to in the trade as "pinning." Then the rig is sufficiently loaded with ballast water to ensure the spud cans will support all anticipated work-related and environmental-related loads. In both mat supported and independent leg type jack-up rigs, the legs of the jack-up pass through openings in the barge hull (commonly referred to in the industry as a "platform") on which the MODU floats. The deck of the platform serves to support the drilling derrick, other drilling equipment, quarters, heliport and other machinery. In the trade the barge hull is frequently referred to as the "platform."

After the jack-up rig is transported to a pre-selected drilling site and is floating on the platform, the legs are jacked down in contact with the sea floor and the platform is jacked up on the legs until the platform is clear of the water's surface and well above the high waves. Large motors and a gripping system are used to raise or lower the legs as they pass through the platform. In some cases, each leg has a rack and pinion gear associated therewith. The pinion gears are powered by electric or hydraulic motors and the rack is attached to the leg.

When a jack-up is finished drilling and it is to move from one location to another, the platform is jacked down to the water line where the platform is capable of floating. The legs are then jacked upward and free from the ocean floor, wherein the jack-up rig floats on the platform.

The present invention is primarily applicable to independent leg jack-ups; therefore, subsequent discussions will concentrate on independent leg jack-ups as opposed to mat supported jack-ups. When the legs of an independent jack-up are fully elevated, the platform draws approximately 15 feet of water. If the jack-up is towed to a new location, it is capable of a maximum towing speed of approximately 5 knots. However, in rough seas the legs must be lowered to increase the stability of the jack-up. The increased drag of the legs combined with strong winds and/or currents may reduce the progress to towing speeds of less than 1 knot. Obviously, if a rig is to be moved a long distance such speeds are economically unacceptable.

In the prior art, dry lift carriers have been successfully used to move jack-ups at economical speeds. The prior art dry lift carriers are typically cargo or oil tanker ships which have had a portion of the upper decks and hull removed and replaced with a flat deck for receiving the jack-up rig. Stability columns are added on the fore and aft ends of the carrier. The dry lift carrier vessel is so named because the jack-up rig goes from a floating "wet mode" to a "dry mode" when loaded on the deck of the carrier.

Loading an independent leg jack-up on a dry lift carrier is accomplished in the following manner. The legs of the jack-up are fully elevated and the rig floats on the barge hull. The carrier is partially submerged by selective flooding of compartments in the hull and the carrier is floated into position under the platform of the jack-up. The carrier is de-ballasted by evacuating the flooded compartments and as the carrier becomes more buoyant and rises it takes on the weight of the jack-up rig on the carrier deck and the jack-up is raised from a wet mode to a "dry" mode in a manner similar to a shipyard dry dock. Alternatively in shallow water environments, the carrier may be submerged and rests on the sea floor. The jack-up rig is floated into position above the carrier. The carrier is deballasted as heretofore described. When deballasted, the carrier may transport the jack-up rig at speeds of approximately 15 knots.

Presently, there are approximately 500 jack-up rigs worldwide. Currently there are only about 12 to 15 dry lift carriers suitable for transporting jack-up rigs and of these only 6 to 8 are economically viable. As a consequence, transportation fees are quite high.

In prior art dry lift carriers, the platform of the jack-up must be supported on the deck of the carrier by timber cribbing. The cribbing is necessary to distribute the load of the platform over the deck of the carrier and for preventing damage to the underside of the platform by direct contact with the deck of the carrier. Additionally, because different jack-up rigs have somewhat different platform sizes, shapes and spacing for the legs (known in the trade as "footprints") and sizes and shapes of the platform, a customized cribbing design and load calculation must be established for each jack-up rig prior to its loading onto a carrier vessel. Additionally, customized design and calculations must be performed for sea-ties which resist lateral and transverse movement of the jack-up rig on the deck of the carrier vessel. Furthermore, many jack-up rigs do not have the capability to retract the spud cans fully into the bottom of the platform and thereby form a flat bottom. As a result it may be necessary to make one or more customized adaptations (referred to in the trade as "dimples") in the deck of the carrier. In some instances, portions of the deck must actually be cut away and bulkheads and new decking installed to accommodate the spud cans on the deck of the carrier. Therefore, a need exists for a standardized dry lift carrier that provides more efficient and economical transportation of jack-up rigs of varying footprints.

SUMMARY OF THE INVENTION

In accordance with the present invention many of the disadvantages of the prior art dry lift carriers have been overcome. The dry lift carrier of the present invention comprises a hull formed from a plurality of wall members enclosing a plurality of ballast compartments, a deck and stability columns fore and aft. The dry lift carrier further includes three vertical openings, (hereinafter referred to a "leg wells") that pass entirely through the deck and hull of the carrier. Additionally, three pinning receptacles filled with graded material are positioned in the deck of the carrier. In loading operations, the dry lift carrier of the present invention is first partially submerged by means of flooding the ballast compartments and then positioned beneath a floating jack-up rig. The dry lift carrier is then re-floated thereby raising the jack-up rig from a floating "wet" mode to a "dry" mode on the deck of the carrier. The jack-up drilling rig is then capable of being transported on the deck of the carrier to another location.

Several special features of the leg wells distinguish the present invention over the prior art carriers. Legs of jack-up rigs may be in excess of 300 feet in length. When the legs are raised into the air during transportation, the extreme height of the legs can contribute to instability of the jack-up rig and its transportation vessel. The three leg wells of the present invention are positioned in the same triangular pattern spacing as the legs of the jack-up drilling rig to be transported. In a first mode of transportation, if rough seas are anticipated, the legs are lowered down through the leg wells, thereby increasing the stability of the jack-up rig and the carrier. Lowering the legs through the leg wells in rough seas also assists in preventing damage to the jack-up legs. In a second alternative mode of transportation, each pinning receptacle of the present invention receives a corresponding spud can and leg of the jack-up rig, thereby "pinning" the rig to the deck. This pinning eliminates the need for cribbing used on conventional transportation vessels during transport of a jack-up rig. Furthermore, because in the second mode of operation the hull does not necessarily rest on the deck of the carrier, the carrier may serve as a floating dry dock and the hull of the jack-up rig may be inspected and worked on during transportation.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
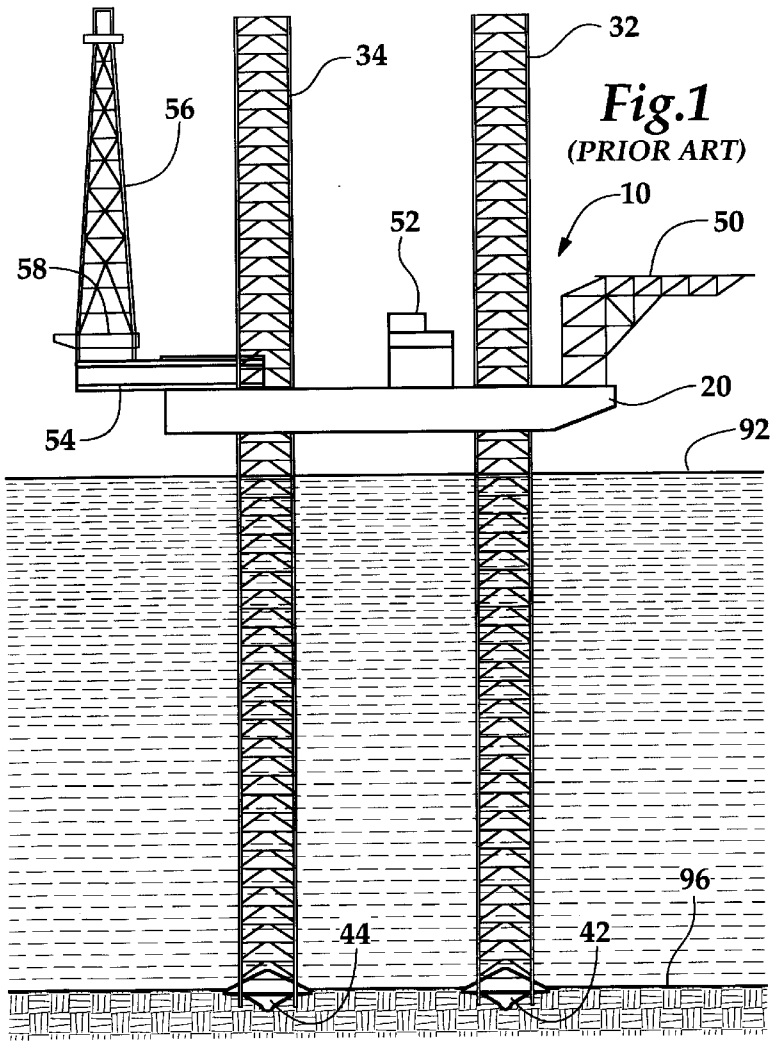
Fig.1 (PRIOR ART)
FIG. 1 is an elevation view of a prior art independent leg jack-up rig positioned for drilling operations.

Reference is now made to the Drawings wherein like reference characters denote like or similar parts throughout the FIGS. Referring to FIG. 1, therein is illustrated a prior art independent leg jack-up rig 10 in a drilling mode. The jack-up rig 10 includes a generally triangular shaped floatable barge hull commonly referred to in the trade as a platform 20, three independent legs 32, 34 and 36, each positioned in proximity to a respective corner of the triangular platform 20. Each of the legs 32, 34, 36 are formed from structural members in a truss type arrangement. Frequently the truss members are arranged in a triangular horizontal cross section but may have a square or other type cross section. The distal end of each of the legs 32, 34, and 36 are terminated with a bearing member referred to in the trade as a "spud can" 42, 44 and 46. The spud cans 42, 44 and 46 have a generally horizontal circular cross section and convex bearing surfaces that may terminate in a point.

During drilling operations the jack-up rig 10 is stationary and supported by the legs 32, 34, and 36 and spud cans 42, 44 and 46 bearing on the sea floor 96. The upper surface of the platform supports a helipad 50, quarters 52 and sometimes a cantilever beam 54. The cantilever beam 54 is capable of lateral movement and is used to cantilever the drilling derrick 56 and drill floor 58 out from the side of the platform to facilitate positioning the drill hole in a precise pre-selected location. The jack-up rig includes other equipment well-known in the art.

Figure 2:
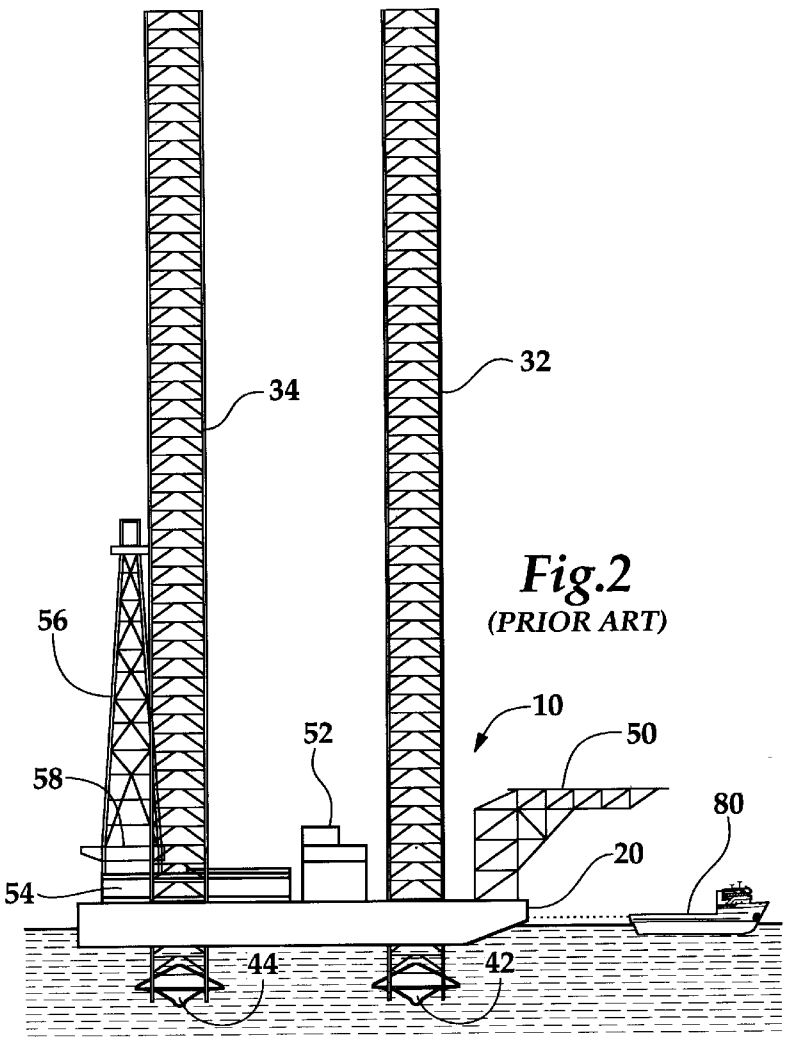
Fig.2 (PRIOR ART)
FIG. 2 is an elevation view of the prior art jack-up rig of FIG. 1 in a floating "wet" mode being towed by a tug boat to a new location.

Referring now to FIG. 2 therein is illustrated the prior art jack-up rig 10 in a floating "wet" mode being towed to a new location by tug 80. The legs 32, 34 and 36 have been elevated and the rig 10 is floating on the platform 20. The cantilever beam 54 has been retracted and the derrick 56 is no longer cantilevered over the side of the platform. Retracting the cantilever beam 54 and derrick 56 shifts substantial weight toward the center of gravity of the jack-up rig and provides additional stability against overturning. The trussed legs 32, 34 and 36 are frequently over 300 feet in length and may have weights in excess of 4000 to 5000 pounds per lineal foot. Raising or lowering the legs 32, 34 and 36 dramatically affects the center of gravity of the jack-up rig 10. In order to reduce drag forces and increase towing speed, it is desirable to elevate the legs fully and have only a minimal portion of the leg projecting below the platform in the water. When the legs 32, 34, and 36 are fully elevated, the platform 20 draws approximately 15 feet of water and the jack-up rig 10 can be towed at approximately 5 knots per hour. However, fully elevating the legs raises the center of gravity and decreases the stability of the rig as it is being transported. If rough seas are anticipated and the legs must be lowered, the towing speed may be reduced to less than 1 knot per hour.

Figure 3A:
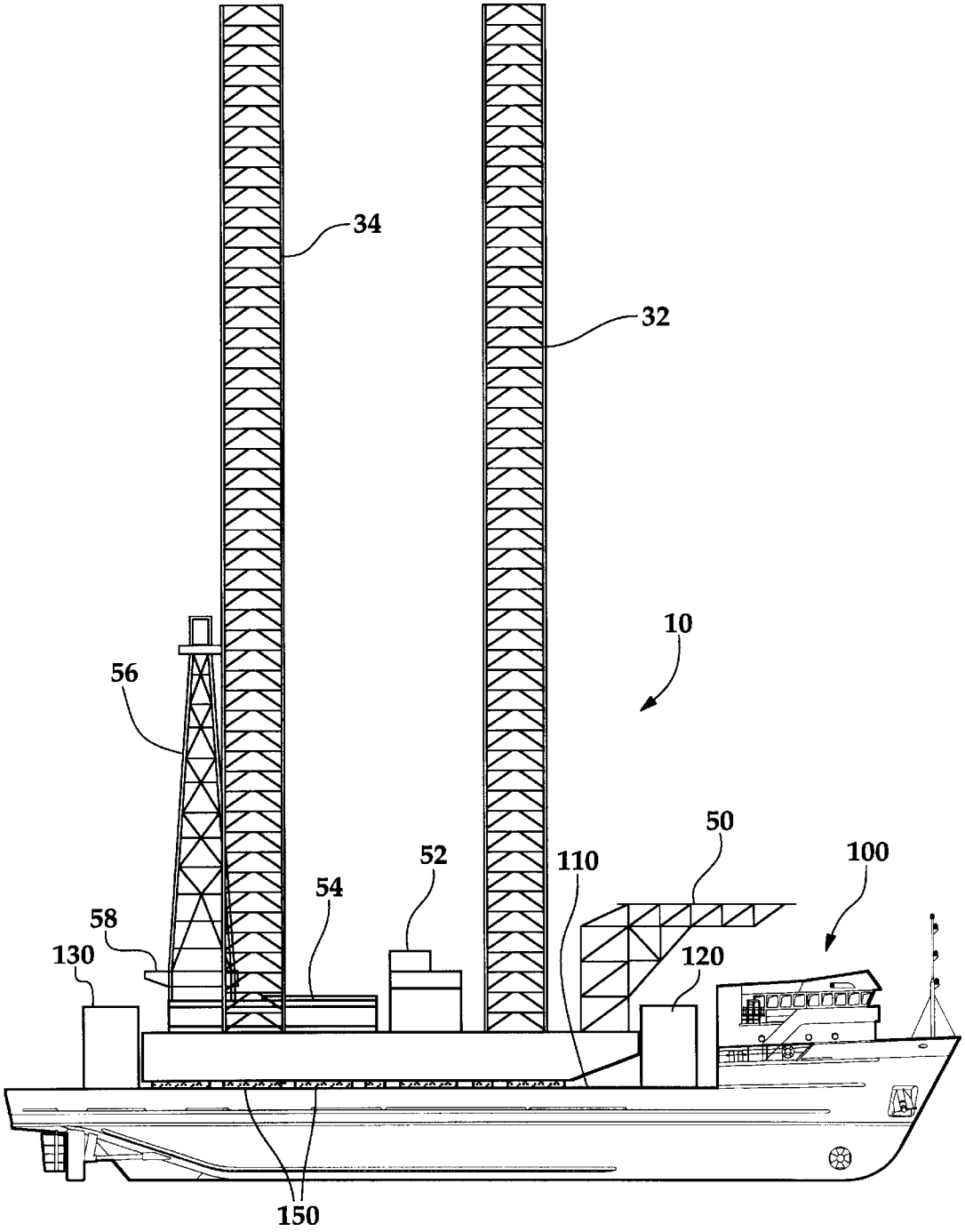
Fig.3A (PRIOR ART)
FIG. 3A is an elevation view of the prior art jack-up rig of FIG. 1 being transported in a "dry" mode by a prior art dry lift carrier to a new location.

Referring to FIG. 3A therein is illustrated the prior art jack-up rig 10 being transported in a "dry" mode by a prior art dry lift carrier vessel 100 to a new location. The prior art dry lift carrier vessel 100 is typically fabricated from a former cargo vessel or oil tanker and converted to rig transportation service by removing a portion of the upper decks and hull and replacing them with a flat deck 110 for receiving the jack-up rig 10. Stability columns 120 and 130 are generally added to the fore and aft sections respectively of the vessel 100. The stability columns 120 and 130 include buoyant compartments and are of sufficient height that they project above the water surface when the carrier 100 is partially submerged and in position for insertion under the jack-up rig 10.

Figure 3B:
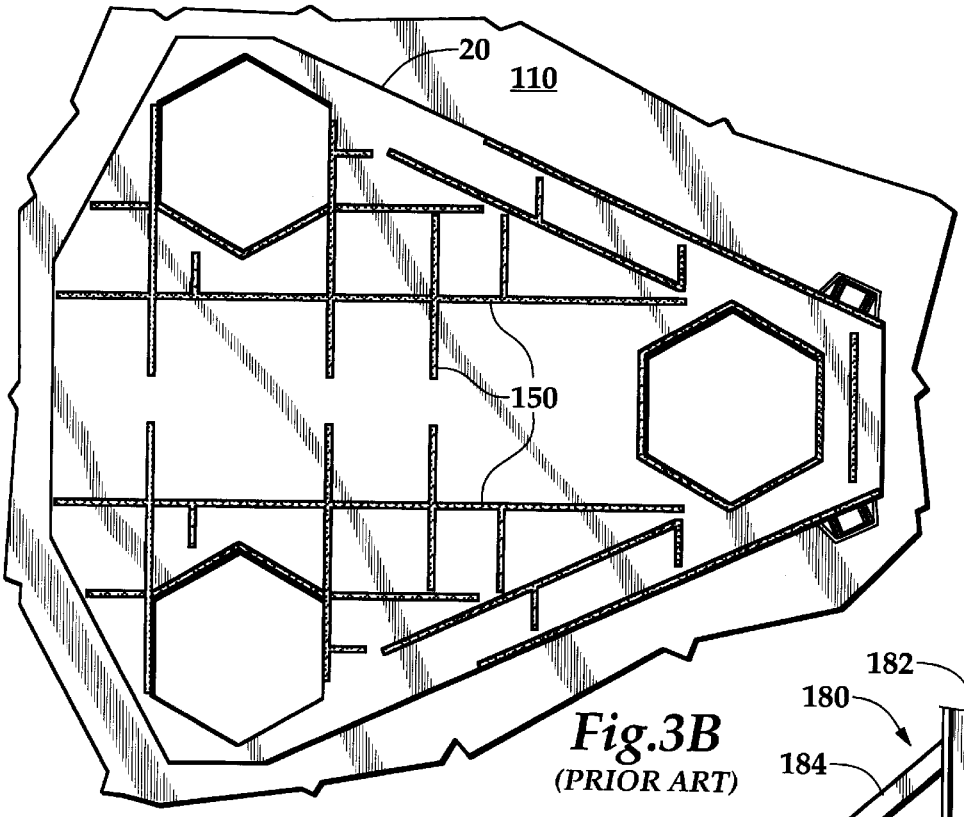
Fig.3B (PRIOR ART)
FIG. 3B is a plan view of a cribbing arrangement for supporting the jack-up rig of FIG. 1 on the deck of the prior art dry lift carrier of FIG. 3A.

Referring to FIG. 3B therein is illustrated a plan view of a typical cribbing arrangement used to support the platform 20 of the jack-up rig 10 on the deck 110 of carrier vessel 100. Cribbing 150 is typically comprised of 12 inch by 12 inch square timbers. Pressure applied by the cribbing 150 to the deck of the vessel may range from 10 to 50 kips/sq. ft. Because a single level cribbing 150 only elevates the platform approximately 12 inches above the deck 110, it is impossible to inspect or repair the bottom of the platform during transportation. Additional layers of cribbing are expensive and may create stability problems.

Figure 3D:
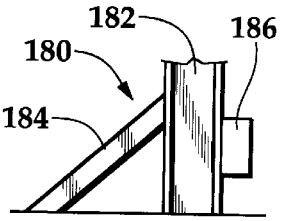
Fig.3D (PRIOR ART)
FIG. 3D is a partial elevation view of a typical sea-tie used in FIG. 3C.
Figure 3C:
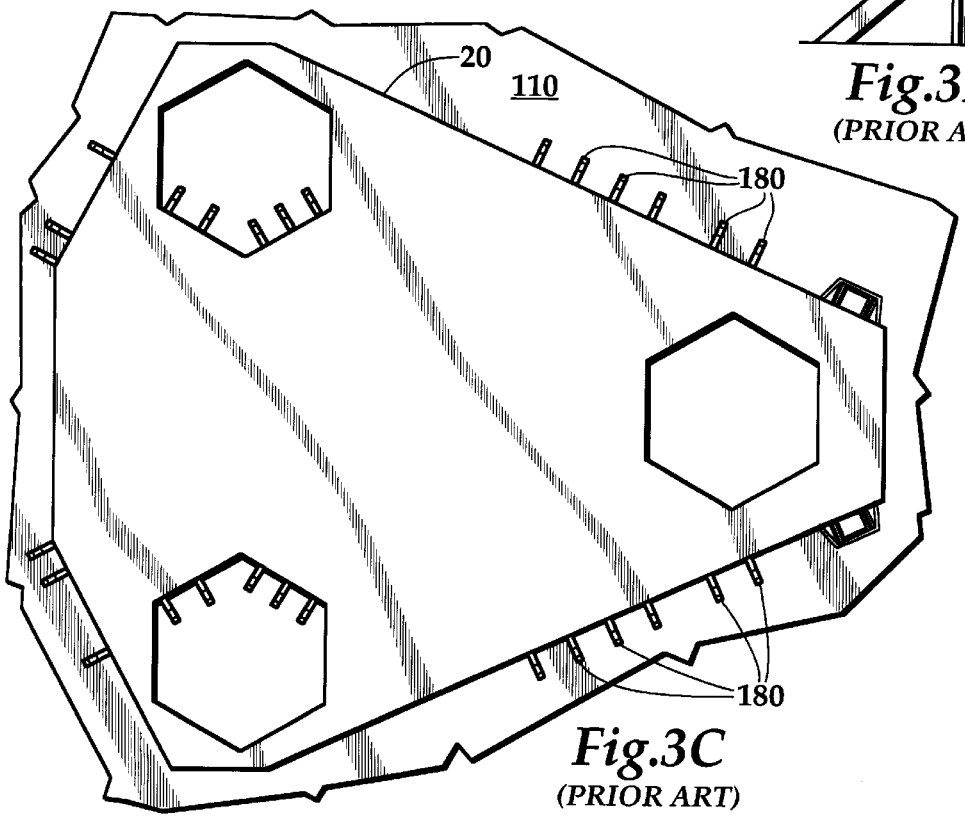
Fig.3C (PRIOR ART)
FIG. 3C is a plan view of a sea-fastening arrangement for securing the jack-up rig of FIG. 1 to the deck of the prior art dry lift carrier of FIG. 3A.

Referring to FIG. 3C therein is illustrated a plan view of the sea-fastening members 180 typically used to attach the jack-up rig 10 to the deck 110 of the carrier vessel 100. The sea-fastening members 180 are positioned to resist longitudinal movement of the jack-up rig 10 on the vessel deck 110. Referring to FIG. 3D therein is illustrated a partial elevation view of a typical fastening member 180. The member is comprised of a vertical portion 182 typically fabricated from a steel W or I section and an angle brace 184 typically fabricated from a steel angle, W or I section and a elastomeric bumper 186 which contacts the platform and prevents damage thereto.

Loading the jack-up rig 10 on the prior art dry lift carrier 100 is accomplished in the following manner. The legs of the jack-up are fully elevated and the rig floats on the barge hull 20. The carrier 100 is partially submerged by selective flooding of compartments in the hull and the carrier is floated into position under the barge hull 20 of the jack-up 10. The carrier 100 is de-ballasted by evacuating the flooded compartments and as the carrier becomes more buoyant and rises it takes on the weight of the jack-up rig 10 on the carrier deck 110 and the jack-up is raised from a wet mode to a "dry" mode in a manner similar to a shipyard dry dock. Sometimes the carrier 100 is submerged at the stern end at an angle to the bow end in order to protect the bow end. Some prior art dry lift carriers are narrow enough that the jack-up rig 10 is loaded on the deck 110 with the axis of the rig platform 20 transverse to the longitudinal axis of the carrier 100. Two of the jack-up legs are positioned over the port edge of the vessel and one on the starboard side of the carrier. Alternatively, the axis of the platform 20 may be placed parallel to the longitudinal axis of the vessel and one leg positioned over the port side, one leg over the starboard side and the third leg positioned on the deck 110 of the carrier 100. The carrier may transport the jack-up rig at speeds of approximately 15 knots and may be operated in either a self-propelled mode or in a towed "barge" mode.

Figure 4A:
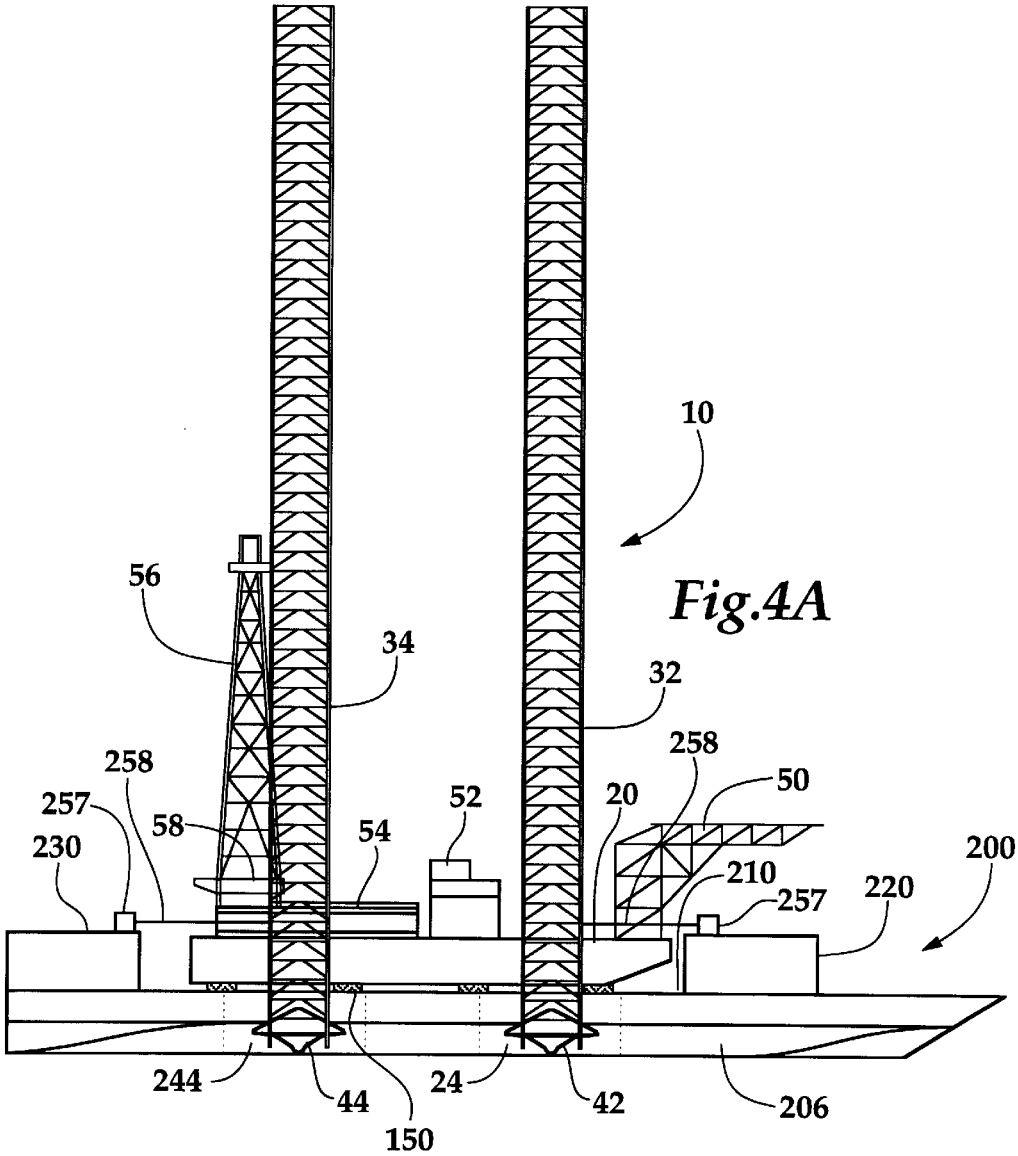
FIG. 4A is an elevation view of the dry lift carrier of the present invention transporting the prior art jack-up rig of FIG. 1 to a new location.
Figure 4B:
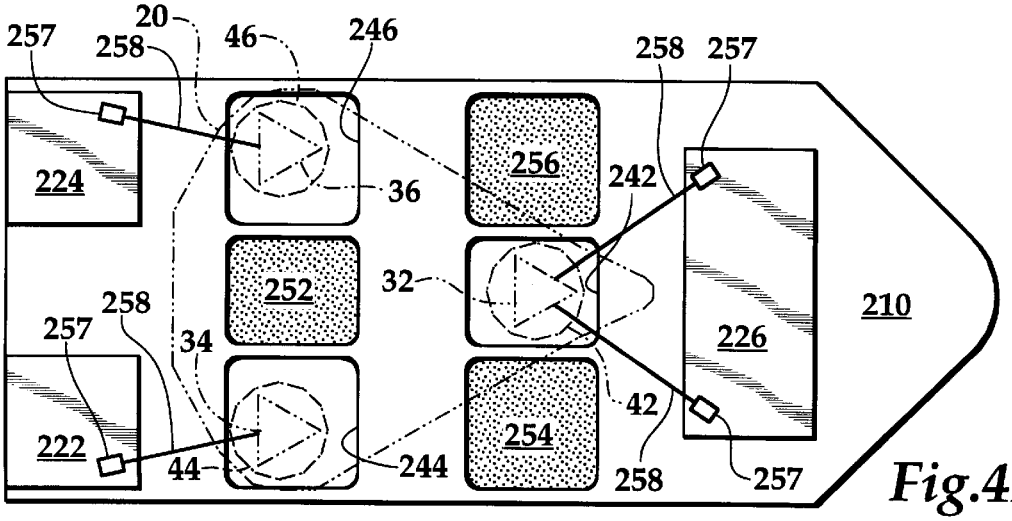
FIG. 4B is a plan view of the dry lift carrier of FIG. 4A with the platform and legs of the jack-up rig superimposed in phantom.

Referring now to FIG. 4A and 4B therein is illustrated a dry lift carrier 200 of the present invention transporting the prior art jack-up rig 10 in a "dry" mode to a new location. In FIG. 4B, triangular shaped platform 20 of jack-up rig 10 is illustrated in phantom, positioned with spud cans 42, 44 and 46 and legs 32, 34 and 36 passing through leg wells 242, 244 and 246 respectively.

Referring to FIGS. 4A, 4B, 5, 6 and 7 the dry lift carrier 200 of the present invention comprises a hull 206 having a plurality of internal ballast compartments defined by box girders 212 and 214 and watertight bulkheads 216, a deck 210 and stability columns 222 and 224 located aft and stability column 226 located fore. The stability columns 222, 224 and 226 include buoyant compartments and project above the water line when the remainder of the carrier 200 is partially submerged by selectively flooding the internal ballast compartments in the hull.

Figure 7:
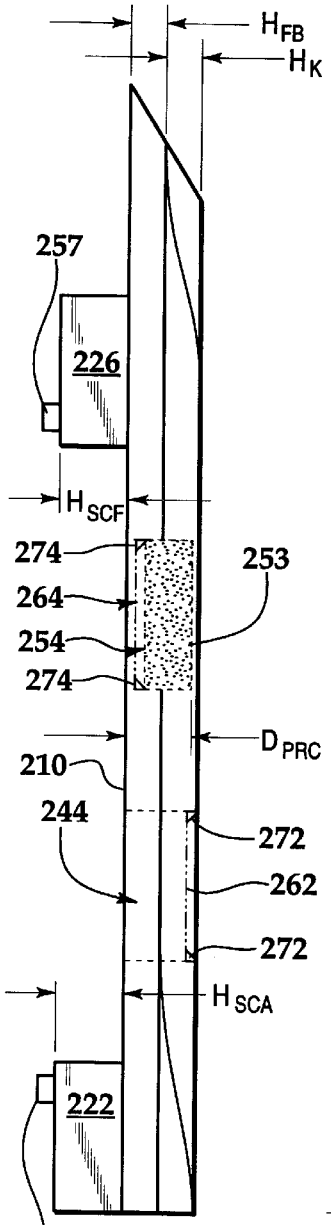
FIG. 7 is an elevation view of the dry lift carrier of FIG. 5.
Figure 5:
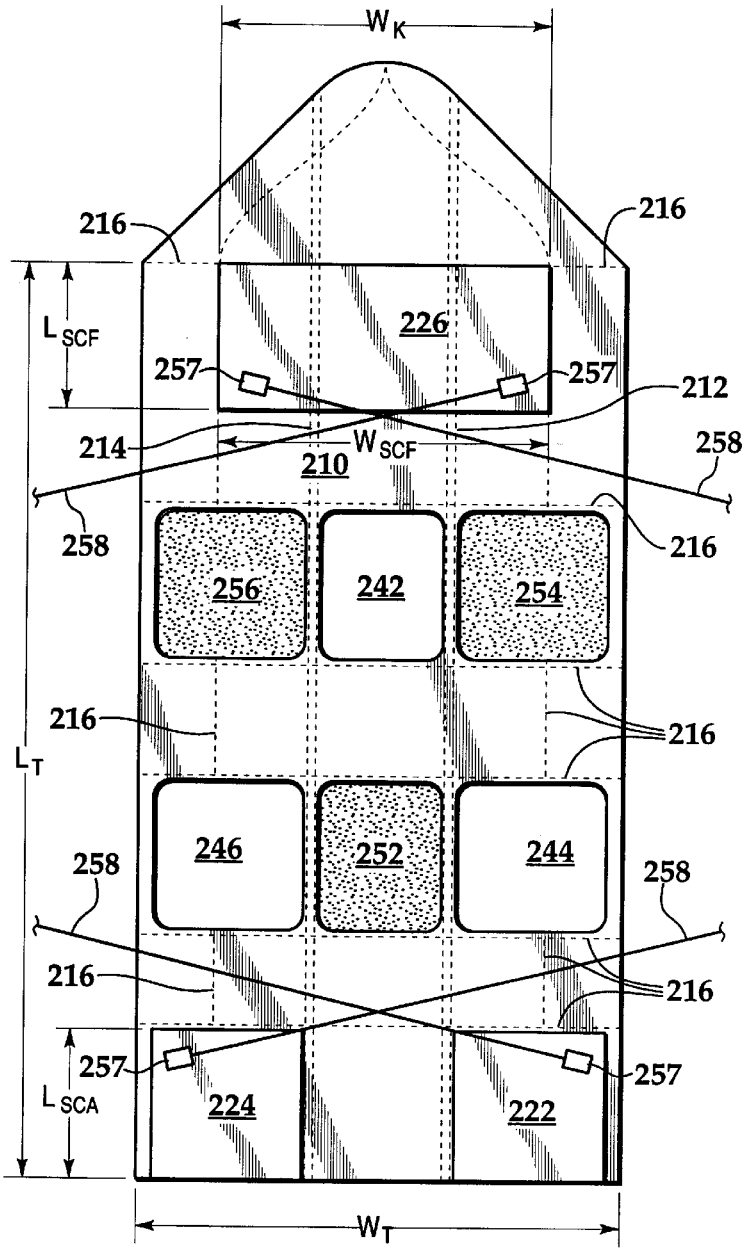
FIG. 5 is a plan view of the dry lift carrier of the present invention illustrating the carrier without the jack-up rig superimposed.
Figure 6:
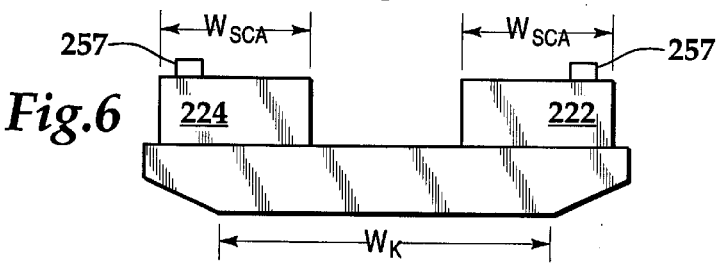
FIG. 6 is an end view of the dry lift carrier of FIG. 5.

Referring in particular to FIGS. 5, 6, and 7, the total length $L_T$ of the hull 206 of the carrier 200 of the present invention is approximately 500 feet. It will be understood by those skilled in the art that the barge may be made longer and thereby suitable for transportation of semi-submersible drilling rigs as well as jack-up rigs. The total width $W_T$ is 211 feet. The width of the keel $W_K$ is 146 feet. The length of the fore stability column $L_{SCF}$ is 65 feet and the width $W_{SCF}$ is 146 feet. The height $H_{SCF}$ of the fore stability column is 30 feet above the deck 210 of the carrier 200. The length of each of the aft stability columns $L_{SCA}$ is 68 feet and the width $W_{SCA}$ of each is 67 feet. The height of the keel $H_K$ is 15 feet and the height $H_{FB}$ of the free board portion of the hull is 15 feet.

Figure 8:
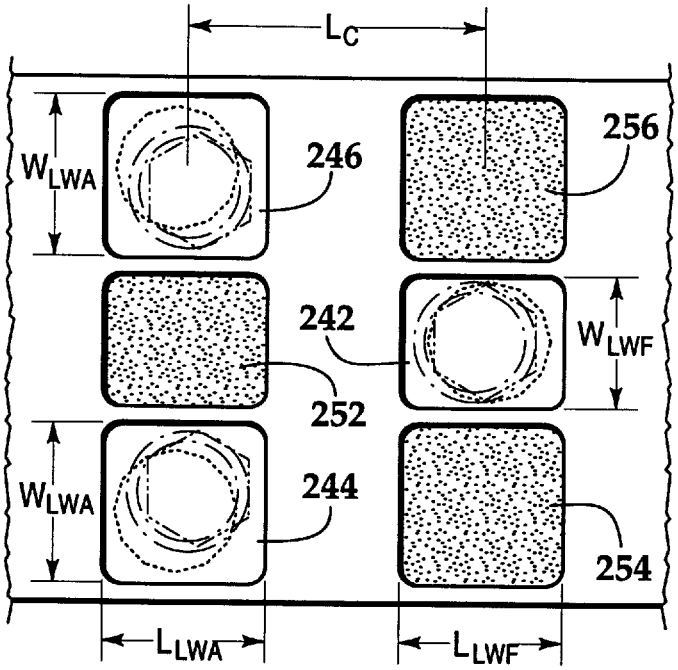
FIGS. 8 and 9 are enlarged partial plan views of the deck portion of the dry lift carrier of the present invention illustrating the pinning receptacles and the leg wells of the present invention with footprints of several types of prior art jack-up rigs superimposed thereon.

The dry lift carrier 200 further includes three vertical openings ("leg wells") 242, 244 and 246 that pass entirely through the deck 210 and hull 206 of the carrier. Referring to FIG. 8, the aft leg wells 244 and 246 have a length $L_{LWA}$ of 65 feet and a width $W_{LWA}$ of 67 feet. The fore leg well 242 has a length $L_{LWF}$ of 65 feet and a width $W_{LWF}$ of 55 feet. Additionally, three pinning receptacles 252, 254, and 256 are positioned in the deck 210 of the carrier 200. The pinning receptacles 252, 254 and 256 include a bottom 253 and a depth $D_{PRC}$ of 20 feet measured from the deck 210. The pinning receptacles 252, 254 and 256 are filled with sand and graded gravel to a depth of 15 feet. The aft pinning receptacle 252 has a length $L_{PRA}$ of 65 feet and a width $W_{PRA}$ of 55 feet. The fore pinning receptacles 254 and 256 have a length $L_{PRF}$ of 65 feet and width $W_{PRF}$ of 67 feet. A centerline through the fore leg well 242 and fore pinning receptacles 254 and 256, is displaced a distance $L_C$ of 121 feet forward of a centerline passing through aft leg wells 244 and 246 and aft pinning receptacle 252.

Referring to FIG. 7, the present invention further includes a plurality of covers, one each for covering the open end of pinning receptacles 252, 254 and 256, respectively. Pinning receptacle 254 is illustrated with cover 264 received on ledge 274. Though not illustrated, it will be understood by those skilled in the art that similar covers may be installed in a similar manner in pinning receptacles 252 and 256 to provide an exterior surface substantially flush with deck 210. Additionally, covers may be inserted into a lower portion of the leg wells 242, 244 and 246, respectively, and landed on internal ledges and locked in place. Leg well 242 is illustrated with cover 262 being received on ledge 272. Though not illustrated, it will be understood by those skilled in the art that similar covers may be installed in leg wells 244 and 246 thereby providing an external surface substantially flush with the bottom of the barge 200. Insertion of the covers in the leg wells 252, 254 and 256 significantly reduces drag and increases the speed of carrier 200. It will be understood that a variety of fixed and retractable ledges as known in the art are suitable for the intended purpose.

Several special features of the leg wells 242, 244 and 246 of the present invention provide advantages over the prior art carriers. First, the legs 32, 34 and 36 of jack-up rig 10 may be in excess of 300 feet in length and weigh more than 4000 to 5000 pounds per lineal foot. When the legs are raised into the air during transportation, the extreme height and weight of the legs can contribute to instability of the jack-up rig 10 and the carrier vessel 200. In a first mode of transportation, if rough seas are anticipated, the legs 32, 34, and 36 are lowered down through the leg wells 242, 244 and 246, thereby increasing the stability of the jack-up rig 10 and the carrier 200. Additionally, when the jack-up's legs 32, 34 and 36 are elevated they provide a substantial surface upon which the wind may act. If the wind is blowing strongly from port or starboard (transverse to the forward direction of the carrier 200) the wind force on the legs 32, 34 and 36 provides a substantial heel moment attempting to overturn the rig 10 and carrier 200. In a conventional dry lift carrier 100, the direction of travel may have to be adjusted off course in order to reduce the heel moment. However, in the present invention, the legs 32, 34 and 36 may be lowered through leg wells 242, 244 and 246 to reduce the heel moment and add stability to the rig 10 and carrier 200. Additionally, lowering legs 32, 34 and 36 through the leg wells 242, 244 and 246 in rough seas also assists in preventing damage to the jack-up legs.

The second major advantage provided by the leg wells 242, 244 and 246 of the present invention is versatility. The size and spacing of the leg wells are designed to receive the legs and spud cans 42, 44 and 46 from multiple models of jack-up rigs from the same manufacturer and jack-up rigs from multiple manufacturers which may have differing footprints. Referring to FIG. 8, the footprints of several different jack-up rigs are illustrated in phantom demonstrating that the spud cans 42, 44 and 46 and their associated legs will pass through leg wells 242, 244 and 246.

Referring now to FIG. 5, a third major advantage of the leg wells 242, 244 and 246 is providing lateral restraint to the jack-up rig 10 during transportation thereby eliminating the need for customized sea fastening as is used in prior art dry lift carriers (See FIGS. 3C and 3D and associated textual discussion). The leg wells 242, 244 and 246 operate in conjunction with winches 257 and cables 258 to provide lateral restraint for the jack-up rig 10.

In loading operations for a first mode of operation wherein the leg wells 242, 244 and 246 receive the legs 32, 34 and 36, the dry lift carrier 200 of the present invention is first partially submerged by means of flooding the ballast compartments with equipment and methods as known in the art. The partially submerged vessel is then positioned beneath the floating jack-up rig 10. The legs 32, 34 and 36 of the jack-up rig 10 have been previously elevated and the rig is floating on platform 20. The cables 258 from the winches 257 of the dry lift carrier 200 are attached to the legs 32, 34, and 36 and the dry lift carrier is then de-ballasted with conventional pumps or compressed air thereby lifting the jack-up rig 10 from a floating "wet" mode to a "dry" mode on the deck 210 of the carrier 200. Winches 257 take up slack and assist in correctly positioning the jack-up rig 10 on the deck 210 of the carrier 200 as the carrier is re-floated. Ballasting and deballasting as well as winching out and in cables 258 with winches 257 may be conveniently controlled directly on the barge 200 or remotely from auxiliary vessels. Conventional cribbing 150 is positioned between the bottom of the platform 20 and the deck 210 as previously illustrated and discussed with regard to prior art dry lift carriers 100 (See FIG. 3B). If additional lateral support is desired, conventional seafastening can also be used, generally as previously illustrated and discussed with reference to prior art dry lift carrier 100 (see FIG. 3C). The jack-up drilling rig 10 is capable of being transported on the deck 210 of the carrier 200 to another location.

In a second alternative mode of transportation, each pinning receptacle 252, 254 and 256 of the dry lift carrier 200 of the present invention receives a corresponding spud can 42, 44, and 46 and leg 32, 34 and 36 of the jack-up rig 10, thereby "pinning" the rig 10 to the deck 210. The first advantage of pinning receptacles 252, 254 and 256 of the present invention is that the receptacles eliminate the need for cribbing 150 used in the prior dry lift carrier 100 during transport of a jack-up rig 10 (See FIG. 3B and associated discussion). Because the weight of the jack-up rig 10 is transmitted to the carrier 200 via the pinning receptacles 252, 254 and 256, the jack-up rig may be partially elevated on its legs 32, 34 and 36 and, therefore, need not rest on the deck 210 and the carrier 200.

A second major advantage of the pinning receptacles 252, 254 and 256 is that of providing lateral restraint to the jack-up rig 10 during transportation thereby eliminating the need for customized sea fastening as is used in the prior art dry lift carrier 100 (see FIGS. 3C and 3D and associated textual discussion). If additional lateral restraint is necessary, it may be provided by winches 257 and cables 258 as heretofore discussed with regard to the first mode of operation for the subject invention.

As noted above in the second mode of operation of the present invention, platform 20 does not necessarily rest on the deck 210 of the dry lift carrier 200. Because the bottom of the platform 20 may be elevated above the deck 210, the bottom of the platform 20 of the jack-up rig 10 may be inspected and worked on during transportation thereby providing a third major advantage such that the carrier 200 may serve as a floating dry dock.

Figure 9:
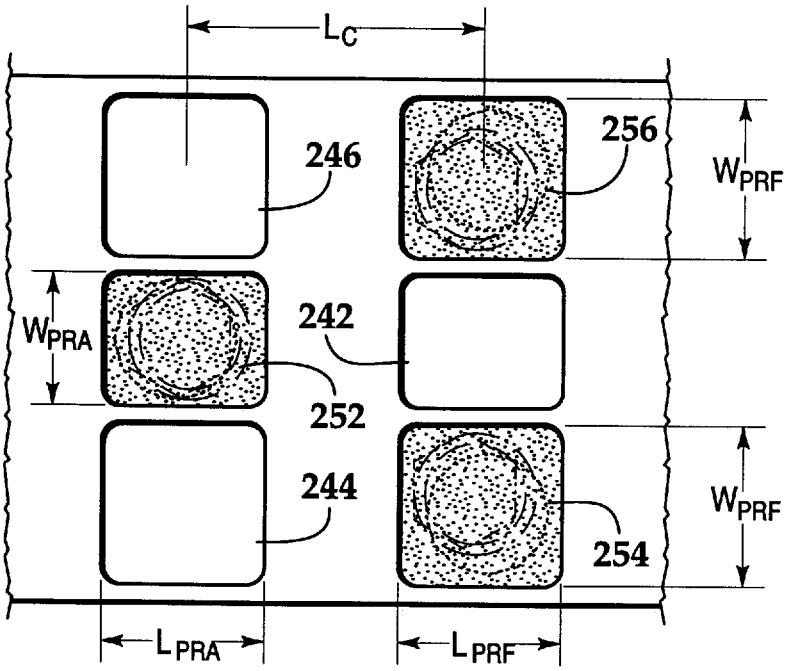
Figure 10A:
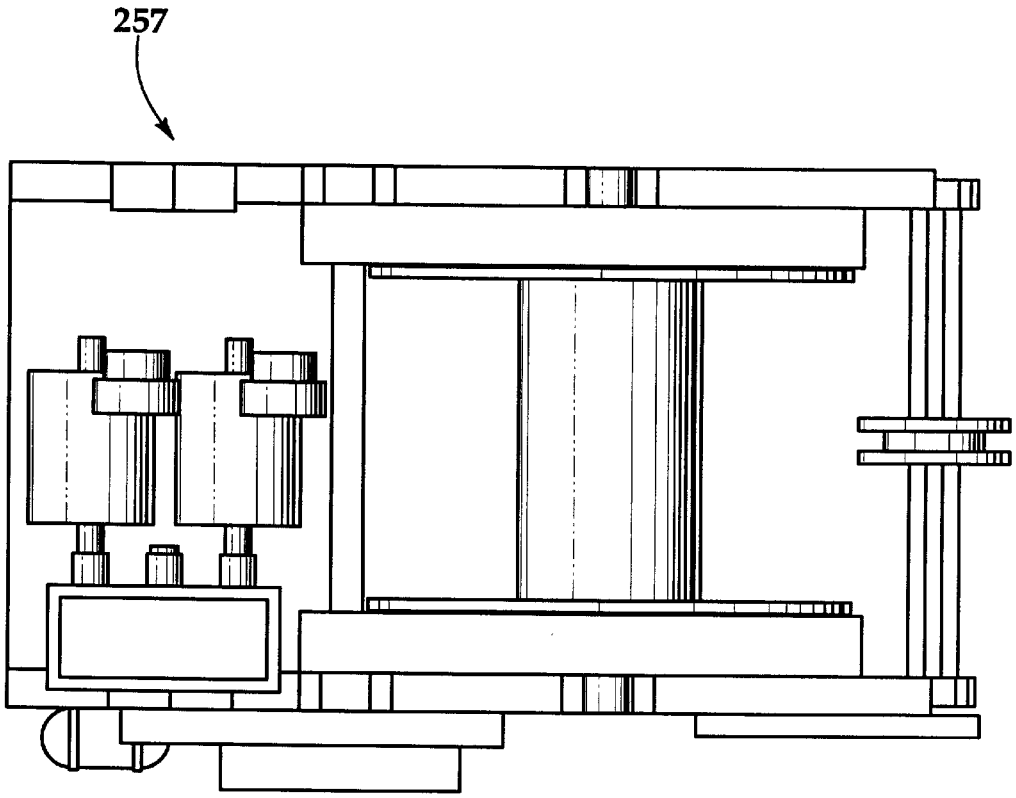
Fig.10A (PRIOR ART)
FIGS. 10A and 10B are plan and elevation views of winches used on the dry lift carrier of the present invention.
Figure 10B:
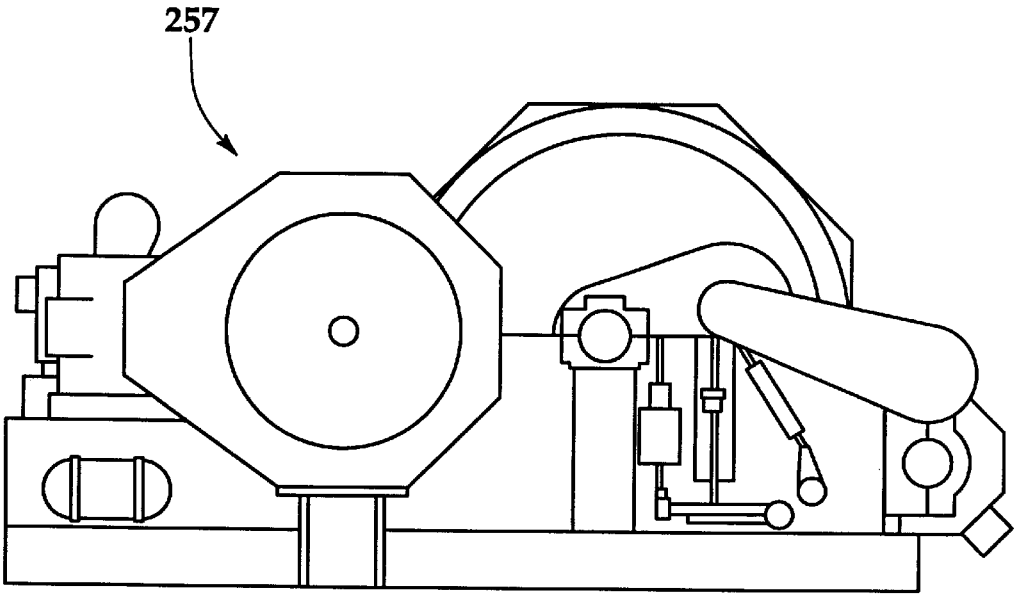
Fig.10B (PRIOR ART)

A fourth major advantage provided by the pinning receptacles 252, 254 and 256 of the present invention is versatility. The size and spacing of the receptacles are designed to receive the legs 32, 34 and 36 and spud cans 42, 44 and 46 from multiple models of jack-up rigs from the same manufacturer and jack-up rigs from multiple manufacturers which may have differing footprints. Referring to FIG. 9, the footprints of several different jack-up rigs are illustrated in phantom demonstrating that the spud cans and legs may be received by the pinning receptacles 252, 254 and 256.

The present invention is designed and manufactured as a carrier with certain advantageous features that converted carriers do not have. Referring to FIG. 5, because the carrier 200 of the present invention is manufactured with an intended purpose as a carrier, the carrier has additional structural strength provided by select positioning of box girders 212 and 214 which provide longitudinal support for the vessel and water tight bulkheads 216 which provide additional structural support for the deck 210.

It will be understood by those skilled in the art that the carrier 200 of the present operation may use two different loading methods. Either loading method is suitable for the first mode of operation wherein the legs 32, 34 and 36 are positioned in leg wells 242, 244 and 246; or the second mode of operation wherein the legs 32, 34 and 36 are positioned in the pinning receptacles 252, 254 and 256. In a "submersible mode" the carrier 200 is submerged until it rests on the ocean bottom 96 and the jack-up 10 is floated over the carrier. The submersible mode is used in modest water depths and provides a more stable target for the jack-up. Alternatively, in the "semi-submersible" mode the carrier 200 is partially submerged but does not rest on the ocean bottom 96 and therefore the carrier can be floated under the floating jack-up 10. This mode may be utilized when the water depth is too great to operate the carrier 200 in the submersible mode.

Although preferred embodiments of the invention have been disclosed in the foregoing Detailed Description, it will be understood that the invention is not limited to the embodiments disclosed, but is capable of numerous rearrangements, modifications, and substitutions of parts and elements without departing from the spirit of the invention. In particular, in the embodiment illustrated and discussed herein, the dry lift carrier 200 is depicted as a "dumb" barge that will be towed by another vessel. However, it will be understood by those skilled in the art that the barge may be self propelled with engines or electric motors linked in a conventional manner to propellers as is well known in the marine art. It will also be understood that the exterior hull may be formed in any number of shapes and may take on the appearance and some of the characteristics of a ship hull instead of a barge hull without departing from the claimed invention. Furthermore, it will be understood that the present invention may be used to transport matted jack-up rigs and semi-submersible rigs on the deck by use of conventional cribbing and seafastening methods.

It will be understood by those skilled in the art that the present invention may be used in both marine and fresh water environments and in any body of water including but not limited to lakes, oceans, seas, rivers and canals and a reference herein to any of the above bodies of water is meant to be interchangeable.

We claim:

1. A dry lift carrier for transporting at least two separate jack-up drilling rigs, a second jack-up drilling rig after a first jack-up drilling rig, in a body of water, each of said jack-up drilling rigs having a floatable platform and at least three legs, said carrier comprising:

a hull formed from a plurality of metal plates, said hull having a bottom and internal ballast compartments capable of being flooded and emptied for lowering and raising the carrier;

at least one stability column having buoyant compartments;

a deck affixed to the hull; and at least one leg well comprising a vertical passageway having a first end opening through the deck and a second end opening through the bottom of the hull, said leg well sized for receiving and passing a leg from the first jack-up drilling rig through said leg well when said first jack-up drilling rig is being transported by the dry lift carrier and said leg well sized for receiving and passing a leg from the second jack-up drilling rig through said leg well when said second jack-up drilling rig is being transported by the dry lift carrier after said first jack-up drilling rig has been transported by the dry lift carrier.

2. The dry lift carrier of claim 1, wherein the carrier includes at least three of said leg wells, said leg wells having a predetermined spacing between the leg wells mating the spacing of the legs on the jack-up drilling rigs.

3. The dry lift carrier of claim 2, wherein the carrier further includes a first winch including a first cable and a second winch including a second cable, said first winch disposed on a top side of a first stability column of the carrier and said second winch disposed on a top side of a second stability column, said first winch adapted for securing with the first cable a first leg of the jack-up drilling rig, being transported, to the carrier and resisting lateral movement of the jack-up rig, being transported, in relation to the carrier, and said second winch adapted for securing a second leg of the jack-up drilling rig, being transported, to the carrier with the second cable and resisting lateral movement of the jack-up rig, being transported, in relation to the carrier.

4. The dry lift carrier of claim 3, wherein said first winch further adapted to guide the first leg of the jack-up drilling rig, to be transported, through the first leg well of the carrier and said second winch further adapted to guide the second leg of the jack-up drilling rig, to be transported, through the second leg well of the carrier, when the jack-up rig, to be transported, is positioned over the deck of the carrier.

5. The dry lift carrier of claim 2 further including a leg well cover disposed in a lower portion of said leg well, wherein an exterior surface of said cover is substantially flush with the bottom of the carrier.

6. A dry lift carrier for transporting a jack-up drilling rig in a body of water, said jack-up drilling rig having a floatable platform and at least three legs terminating in a spud can, said carrier comprising:

a hull formed from a plurality of metal plates, said hull having a bottom and internal ballast compartments capable of being flooded and emptied for lowering and raising the carrier;

at least one stability column having buoyant compartments;

a deck affixed to the hull; and at least three pinning receptacles, each receptacle sized for receiving said spud can and leg from a jack-up drilling rig, each of said receptacles comprising:

a bottom member, at least one side member, and an open top, said pinning receptacles having a predetermined spacing between the pinning receptacles mating the spacing of the legs on the jack-up drilling rig.

7. The dry lift carrier of claim 6 further including graded material disposed in each pinning receptacle.

8. The dry lift carrier of claim 6, wherein the carrier further includes a first winch including a first cable and a second winch including a second cable, said first winch disposed on a top side of a first stability column of the carrier and said second winch disposed on a top side of a second stability column, said first winch adapted for securing with the first cable a first leg of the jack-up drilling rig to the carrier and resisting lateral movement of the jack-up rig in relation to the carrier, and said second winch adapted for securing a second leg of the jack-up drilling rig to the carrier with the second cable and resisting lateral movement of the jack-up rig in relation to the carrier.

9. The dry lift carrier of claim 8, wherein said first winch further adapted to guide the first leg of the jack-up drilling rig over the first pinning receptacle of the carrier and said second winch further adapted to guide the second leg of the jack-up drilling rig over the second pinning receptacle of the carrier, when the jack-up rig is positioned over the deck of the carrier.

10. The dry lift carrier of claim 6 further including a pinning receptacle cover disposed in an upper portion of said pinning receptacle, wherein an exterior surface of said cover is substantially flush with the deck of the carrier.

11. A dry lift carrier adapted for transporting a jack-up drilling rig in a body of water, said jack-up rig having a floatable platform and at least three legs, said carrier comprising:

a hull formed from a plurality of metal plates, said hull having a bottom and internal ballast compartments capable of being flooded and emptied for lowering and raising the carrier;

a deck affixed to the hull;

at least three leg wells, each well sized for receiving a leg from a jack-up drilling rig, each of said wells comprising:

a vertical passageway having a first end opening through the deck and a second end opening through the bottom of the hull, said leg wells having a predetermined spacing between the leg wells mating the spacing of the legs on the jack-up drilling rig; and at least three pinning receptacles, each receptacle sized for receiving a spud can and leg from a jack-up drilling rig, each of said receptacles comprising:

a bottom member, at least one side member, and an open top, said pinning receptacles having a predetermined spacing between the pinning receptacles mating the spacing of the legs on the jack-up drilling rig.

12. The dry lift carrier of claim 11 further including:

a leg well cover disposed in a lower portion of said leg well, wherein an exterior surface of said leg well cover is substantially flush with the bottom of the carrier; and a pinning receptacle cover disposed in an upper portion of said pinning receptacle, wherein an exterior surface of said pinning receptacle cover is substantially flush with the deck of the carrier.

13. The dry lift carrier of claim 11 further including at least two stability columns, one located fore and one aft, and further including at least two winches, each winch including a cable, a first winch disposed on a top side of the fore stability column and a second winch disposed on a top side of the aft stability column, said winches adapted for securing with the cable the leg of the jack-up drilling rig to the carrier and resisting lateral movement of the jack-up rig in relation to the carrier.

14. The winches of claim 13 further adapted to guide the jack-up leg through the leg well when the jack-up rig is positioned over the deck of the carrier.

15. A method of transporting a jack-up drilling rig on a dry lift carrier through a body of water, wherein the jack-up rig includes a floatable platform and at least three legs, and wherein the dry lift carrier includes a hull formed from a plurality of metal plates and containing internal ballast compartments capable of being flooded and emptied, a deck affixed to the hull, at least one stability column, at least one leg well sized for receiving a leg from a jack-up drilling rig, said well having a vertical passageway having a first end opening through the deck and a second end opening through the bottom of the hull, said method of transporting comprising the steps of:

floating the jack-up rig on the platform of the jack-up rig;

flooding the ballast compartments of the carrier and partially submerging the carrier below the surface of the water wherein at least one stability column remains above the water's surface;

positioning the carrier beneath the floating jack-up rig with a distal end of one of the legs of the jack-up rig above the leg well in the carrier; and de-ballasting the ballast tanks in the carrier thereby lifting the jack-up rig from a floating wet mode to a dry mode on the deck of the carrier wherein the leg is positioned in a leg well of the carrier.

16. The method of claim 15 further including the step of lowering the jack-up leg through the leg well.

17. The method of claim 15 further including the step of using cables from winches positioned on the carrier to guide the partially submerged carrier and the floating jack-up rig into position.

18. The method of claim 17 further including the step of securing the jack-up rig to the deck of the carrier with a cable from said winches positioned on the carrier.

19. A method of transporting a jack-up drilling rig on a dry lift carrier through a body of water, wherein the jack-up rig includes a floatable platform and at least three legs, and wherein the submersible carrier includes a hull formed from a plurality of metal plates and containing internal ballast compartments capable of being flooded and emptied, a deck affixed to the hull, at least one stability column, at least three leg wells, each sized for receiving a leg from a jack-up drilling rig, each of said wells having a vertical passageway having a first end opening through the deck and a second end opening through the bottom of the hull, and said leg wells having a predetermined spacing mating the spacing of the legs on the jack-up drilling rig, said method of transporting comprising the steps of:

floating the jack-up rig on the floatable platform of the jack-up drilling rig;

flooding the ballast compartments of the carrier and partially submerging the carrier below the surface of the water wherein at least one stability column remains above the water's surface;

positioning the carrier beneath the floating jack-up rig with a distal end of each of the legs of the jack-up rig above each leg well in the carrier; and de-ballasting the ballast tanks in the carrier thereby lifting the jack-up rig from a floating wet mode to a dry mode on the deck of the carrier wherein each of the legs is positioned in the leg well of the carrier.

20. The method of claim 19 further including the step of lowering one or more of the jack-up legs through the leg well.

21. The method of claim 19 further including the step of using cables from winches positioned on the carrier to guide the partially submerged carrier and the floating jack-up rig into position.

22. The method of claim 19 further including the step of securing the jack-up rig to the deck of the carrier with cable from winches positioned on the carrier.

23. A method of transporting a jack-up drilling rig on a submersible dry lift carrier through a body of water, wherein the jack-up rig includes a floatable platform and at least three legs, and wherein the carrier includes a hull formed from a plurality of metal plates and containing internal ballast compartments capable of being flooded and emptied, a deck affixed to the hull, at least one leg well sized for receiving a leg from a jack-up drilling rig, said well having a vertical passageway having a first end opening through the deck and a second end opening through the bottom of the hull, said method of transporting comprising the steps of:

(a) floating the jack-up rig on the floatable platform of the jack-up drilling rig;

flooding the ballast compartments of the carrier and lowering the carrier until the carrier rests on the floor of the body of water;

(b) subsequent to step a, positioning the floating jack-up rig with a distal end of one of the legs of the jack-up rig above the leg well in the carrier; and (c) subsequent to step b, de-ballasting the ballast tanks in the carrier thereby lifting the jack-up rig from a floating wet mode to a dry mode on the deck of the carrier wherein at least one of the legs is positioned in the leg well of the carrier.

24. The method of claim 23 further including the step of lowering the jack-up leg through the leg well, thereby lowering the center of gravity of the jack-up rig.

25. The method of claim 23 further including the step of using cables from winches positioned on the carrier to guide the floating jack-up rig into position over the submerged carrier.

26. The method of claim 23 further including the step of securing a first leg of the jack-up rig to the deck of the carrier with a first cable from a first winch positioned on the carrier, and securing a second leg of the jack-up rig to the deck of the carrier with a second cable from a second winch positioned on the carrier.

27. A method of transporting a jack-up drilling rig with a dry lift carrier through a body of water, wherein the jack-up rig includes a floatable platform and at least three legs terminating at their distal ends in a spud can, and wherein the dry lift carrier includes a hull formed from a plurality of metal plates and containing internal ballast compartments capable of being flooded and emptied, a deck affixed to the hull, at least one stability column, at least three pinning receptacles positioned on the deck, each receptacle having an open top filled with graded material and, each receptacle sized for receiving a spud can and a leg from a jack-up drilling rig, each of said receptacles having a predetermined spacing mating the spacing of the legs on the jack-up drilling rig, said method of transporting comprising the steps of:

floating the jack-up rig on the floatable platform of the jack-up drilling rig;

flooding the ballast compartments of the carrier and partially submerging the carrier below the surface of the water wherein at least one stability column remains above the water's surface;

positioning the carrier beneath the floating jack-up rig with a spud can located on the distal end of each of the legs of the jack-up above each one of the pinning receptacles on the carrier deck; and de-ballasting the ballast tanks in the carrier thereby lifting the jack-up rig from a floating wet mode to a dry mode on the deck of the carrier wherein each of the legs is positioned in the pinning receptacle of the carrier.

28. The method of claim 27 further including elevating the floatable platform of the jack-up rig by means of a jacking mechanism contained on the jack-up rig, thereby raising the bottom of the floatable platform of the jack-up above the deck of the carrier and enabling work to be conducted on the platform while the jack-up rig is being transported.

29. The method of claim 27 further including the step of using cables from winches positioned on the carrier to guide the partially submerged and the floating jack-up rig into position.

30. The method of claim 27 further including the step of securing the jack-up rig to the deck of the carrier with cable from winches positioned on the carrier.

31. A method of transporting a jack-up drilling rig with a dry lift carrier through a body of water, wherein the jack-up rig includes a floatable platform and at least three legs terminating at their distal ends in a spud can, and wherein the dry lift carrier includes a hull formed from a plurality of metal plates and containing internal ballast compartments capable of being flooded and emptied, a deck affixed to the hull, at least three pinning receptacles positioned on the deck, each receptacle having an open top filled with graded material and, each receptacle sized for receiving a spud can and a leg from a jack-up drilling rig, each of said receptacles having a predetermined spacing mating the spacing of the legs on the jack-up drilling rig, said method of transporting comprising the steps of:

floating the jack-up rig on the floatable platform of the jack-up drilling rig;

flooding the ballast compartments of the carrier and lowering the carrier until the carrier rests on the floor of the body of water;

positioning the floating jack-up rig with a spud can located on the distal end of each of the legs of the jack-up above each one of the pinning receptacles on the carrier deck; and de-ballasting the ballast tanks in the carrier thereby lifting the jack-up rig from a floating wet mode to a dry mode on the deck of the carrier wherein each of the legs is positioned in a pinning receptacle of the carrier.

32. The method of claim 31 further including elevating the floatable platform of the jack-up rig by means of a jacking mechanism contained on the jack-up rig, thereby raising the bottom of the jack-up hull above the deck of the carrier and enabling work to be conducted on the platform while the jack-up rig is being transported.

33. The method of claim 31 further including the step of using cables from winches positioned on the carrier to guide the floating jack-up rig into position above the carrier.

34. The method of claim 31 further including the step of securing the jack-up rig to the deck of the carrier with cable from winches positioned on the carrier.

* * * * *

UNITED STATES PATENT AND TRADEMARK OFFICE

CERTIFICATE OF CORRECTION

PATENT NO : 5,855,455

DATED : January 5, 1999

INVENTOR(S) : Frank B. Williford et al

It is certified that error appears in the above-identified patent and that said Letters Patent is hereby corrected as shown below:

On the Title Page:

Item: [ 56 ] References Cited --
U.S. Patent Documents
5,011,335
Delete : Field
Replace with: Fjeld

In the Claims

Claim 28, Column 14, Line 6
Insert: –rig-- after jack-up

Signed and Sealed this

Twenty-eighth Day of December, 1999

*Attest:*

Q. TODD DICKINSON

*Attesting Officer*

*Acting Commissioner of Patents and Trademarks*